US005988918A

United States Patent [19]

Johnson

[11] Patent Number: 5,988,918

[45] Date of Patent: Nov. 23, 1999

[54] FLAT FOLDING WRITING INSTRUMENT

[76] Inventor: Gary D. Johnson, 151 Hudson St., New York, N.Y. 10013

[21] Appl. No.: 09/298,266

[22] Filed: Apr. 22, 1999

Related U.S. Application Data

[60] Provisional application No. 60/083,000, Apr. 24, 1998.

[51] Int. Cl.[6] ..... A45D 40/20

[52] U.S. Cl. ..... 401/88; 401/97

[58] Field of Search ..... 401/88, 89, 91, 401/95, 96, 97

[56] References Cited

U.S. PATENT DOCUMENTS

| | | | |
|---|---|---|---|
| 1,294,802 | 2/1919 | Hess | 401/97 |
| 2,876,739 | 3/1959 | Gauthier | 401/97 |
| 3,010,862 | 11/1961 | Basche | 401/97 |
| 3,168,072 | 2/1965 | Nitta | 401/97 |

*Primary Examiner*—David J. Walczak
*Attorney, Agent, or Firm*—Frishauf, Holtz, Goodman, Langer & Chick, P.C.

[57] ABSTRACT

A flat folding writing instrument includes a generally planar elongated support, the support including a lengthwise direction, and at least two spaced apart living hinges extending in a generally lengthwise direction of the support, so as to divide the support into at least three lengthwise extending sections. A further hinge extends in a generally widthwise direction of the support so as to divide the support into two widthwise extending sections. The support also has two opposite lengthwise edges and a bottom edge. A writing member is secured to one of the lengthwise extending sections in one of the widthwise extending sections, and has a writing point thereof extending below the bottom edge of the support. A locking assembly is provided for securing the two lengthwise extending edges together when the support is folded along the hinges. The support can be folded along the lengthwise extending hinges such that the two opposite lengthwise edges are adjacent to each other and locked in position relative to each other by the locking assembly, so that the writing instrument can be used for writing. A pen cover is provided on the other widthwise extending section for engaging or covering the writing point of the writing member when the support is folded along the further widthwise extending hinge.

20 Claims, 13 Drawing Sheets

FIG. 1
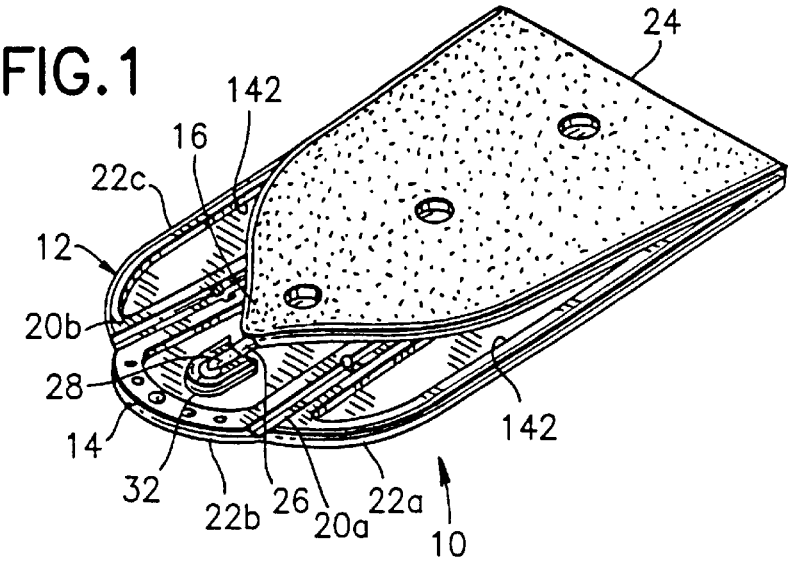
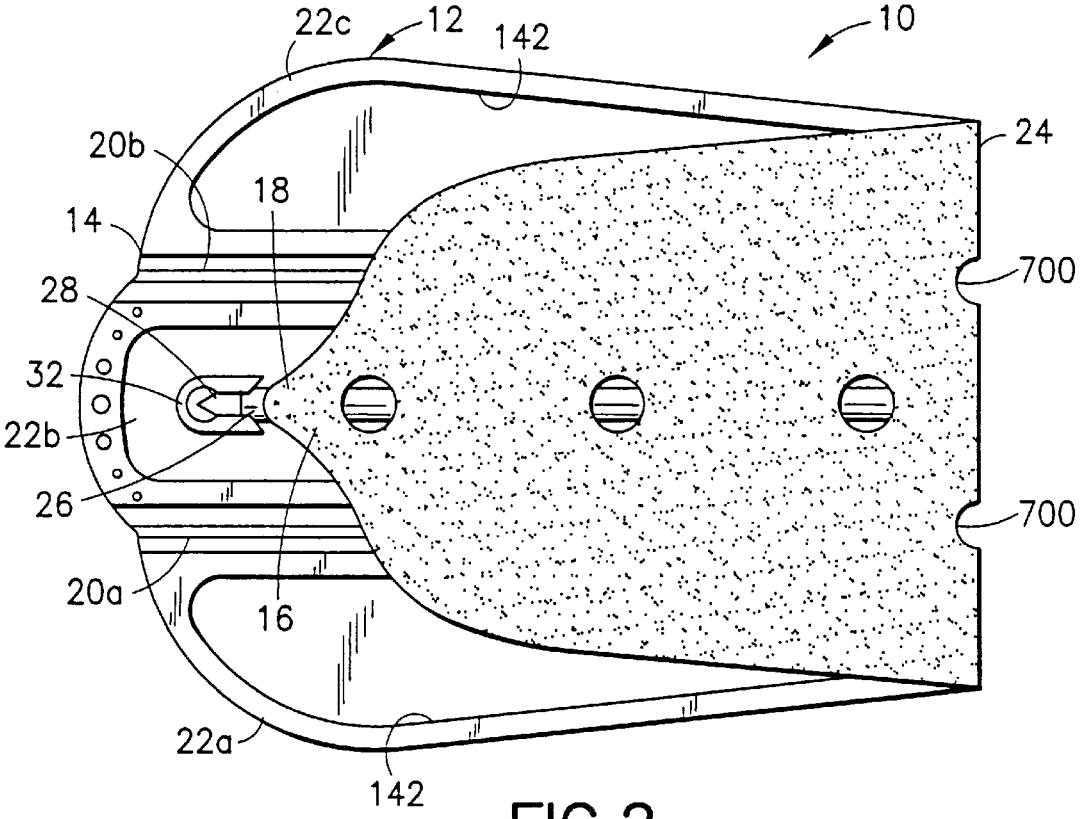
FIG. 2

FIG. 3
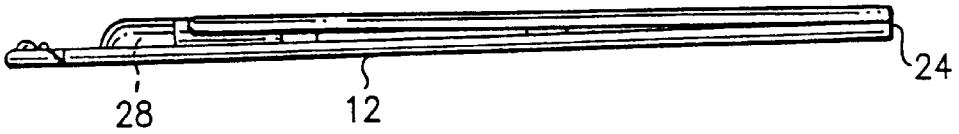
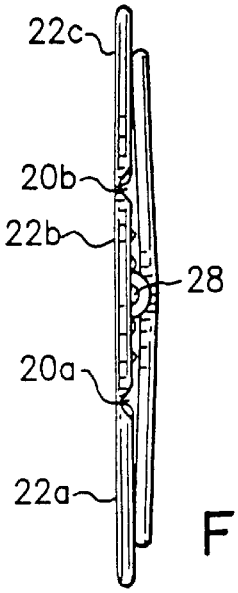
FIG. 4
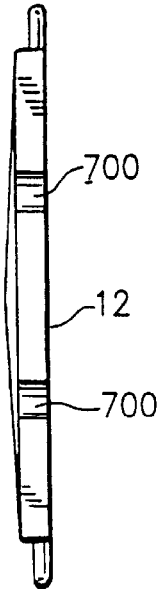
FIG. 5
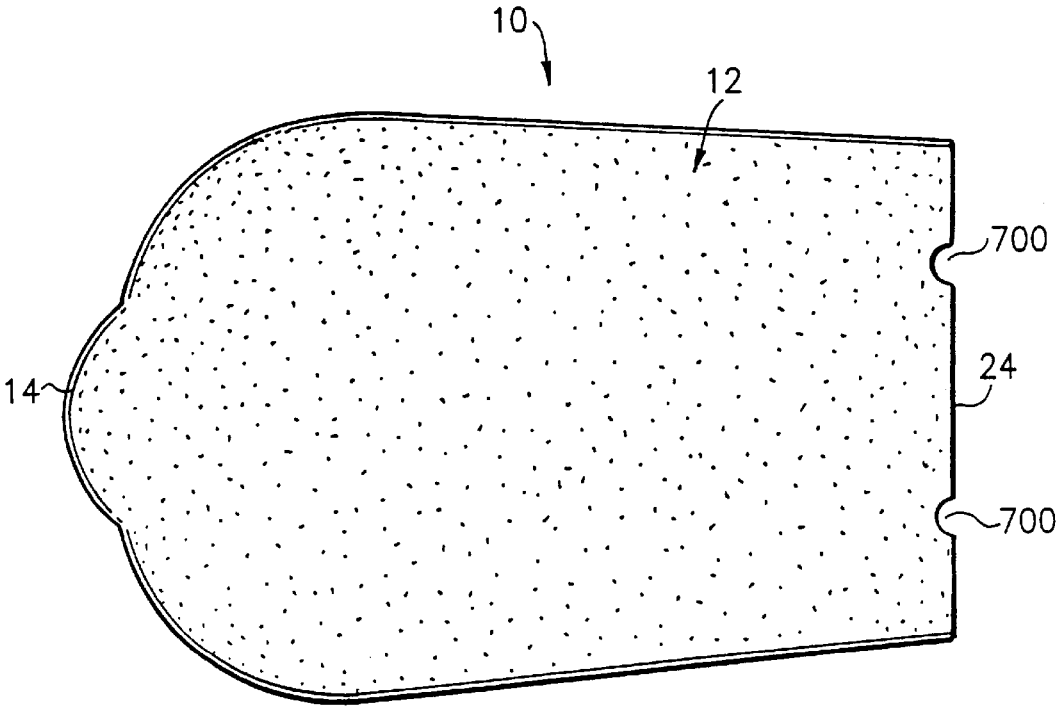
FIG. 6

FIG. 7
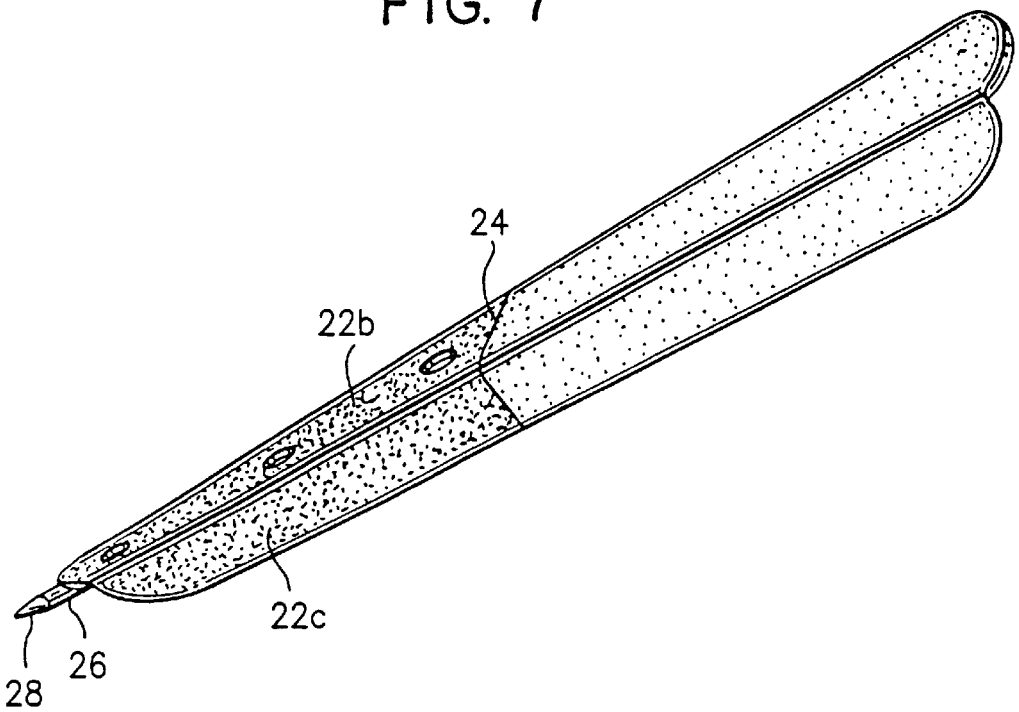
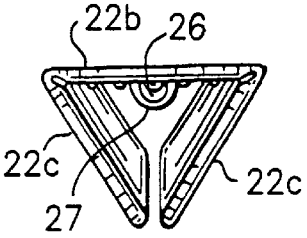
FIG. 10
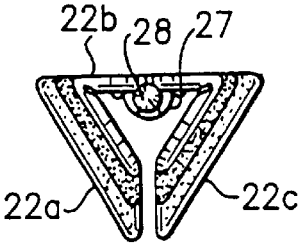
FIG. 11

FLAT FOLDING WRITING INSTRUMENT

CROSS REFERENCE TO RELATED APPLICATION

This application claims the benefit of Provisional Application Ser. No. 60/083,000, filed Apr. 24, 1998, the priority of which is claimed, and the entire contents of which are incorporated herein by reference.

BACKGROUND OF THE INVENTION

The present invention relates generally to writing instruments, and more particularly, is directed to a writing instrument that can be folded and stored in a substantially flat configuration.

Conventionally, writing instruments, such as pens, pencils and the like, are formed in an elongated cylindrical configuration. However, in many instances, it is not convenient to carry such writing instrument, because of the configuration thereof.

It would therefore be desirable to have a pen that can be carried flat in a wallet or the like and then converted into the general configuration of a conventional writing instrument.

SUMMARY OF THE INVENTION

Accordingly, it is an object of the present invention to provide a writing instrument that avoids the aforementioned disadvantages in the prior art.

It is another object of the present invention to provide a writing instrument that can be carried flat (i.e., in a wallet or the like) and then converted into the general configuration of a conventional writing instrument.

It is still another object of the present invention to provide a writing instrument that is easy and economical to manufacture and use.

It is yet another object of the present invention to provide a writing instrument with large, substantially flat, surfaces on which printed matter, such as advertising, can be placed.

In accordance with an aspect of the present invention, a generally flat folding writing instrument includes a generally planar elongated support, the support including a lengthwise direction, at least two spaced apart hinges extending in a generally lengthwise direction of the support, so as to divide the generally planar support into at least three or more lengthwise extending sections, and the support also including two opposite lengthwise edges and a bottom or tip edge; a writing member, such as a pen refill secured, to one of the at least three lengthwise extending sections and having a writing end thereof extending below the bottom or tip edge; wherein the support is foldable along the hinges such that the two opposite lengthwise edges are adjacent to each other when the support is folded, so that the writing instrument can be used for writing.

The generally planar support preferably includes a further hinge extending in a generally widthwise direction thereof so as to divide the support into two widthwise extending sections, and the writing member is secured to only one of the widthwise extending sections.

An automatic writing point cover is secured to the other widthwise extending section for engaging the writing end of the writing member when the support is folded along the further widthwise extending hinge. This is particularly advantageous when the writing member is a pen such as a ball point pen.

Securing members are provided for securing the writing member (pen refill) to the generally planar support. In one embodiment, the securing members include securing arches on the planar support.

Preferably, each hinge is a living hinge (or a scored line formed in the support).

In addition, there is preferably at least one compartment in at least one of the lengthwise extending sections. One flap is associated with each compartment, and each flap is hingedly secured to the generally planar support for removably covering the respective compartment.

In accordance with another aspect of the present invention, a flat folding writing instrument includes a generally planar elongated support, the support including a lengthwise direction, at least two spaced apart hinges extending in a generally lengthwise direction of the support, so as to divide the support into at least three or more lengthwise extending sections, and the support also including two opposite lengthwise edges and a bottom or tip edge; and a pen refill secured to one of the sections and having a ball point thereof extending below the bottom or tip edge. A locking assembly is provided for securing the two edges together when the support is folded along the hinges. The support is foldable along the hinges such that when the support is folded, the two opposite lengthwise edges are adjacent to each other and are locked in folded position relative to each other by the locking assembly, so that the writing instrument can be used for writing. The locks can be automatic, semi-automatic or manual snaps located at outer edges, along the hinges, or basically anywhere else on the pen.

The pen refill or other writing member may be partially flattened to an oval shape to reduce the thickness when the writing instrument is in its flat condition.

The invention will be described in detain hereinbelow in connection with use of a ball point pen refill as the writing member, by way of example. Any other writing implement, such as a pencil, an automatic-feeding pencil, other types of pens (such as a felt tip or other tip pens) may be used, as desired. The description in connection with a ball point pen should not be considered to be limiting of the invention for use only with a ball point pen, as should be apparent.

The above and other objects, features and advantages of the present invention will become readily apparent from the following detailed description which is to be read in connection with the accompanying drawings.

BRIEF DESCRIPTION OF THE DRAWINGS

FIG. 1 is a perspective view of a flat folding writing instrument according to the present invention, in its folded, closed position;

FIG. 2 is a top plan view thereof;

FIG. 3 is a front elevational view thereof, the rear elevational view being a mirror image;

FIG. 4 is a left side view thereof;

FIG. 5 is a right side view thereof;

FIG. 6 is a bottom plan view thereof;

FIG. 7 is a perspective view of the writing instrument in the opened, operative state;

FIG. 10 is a left or rear end view in the opened, operative state;

FIG. 11 is a right front end view in the opened, operative state;

DETAILED DESCRIPTION

Figure 8:
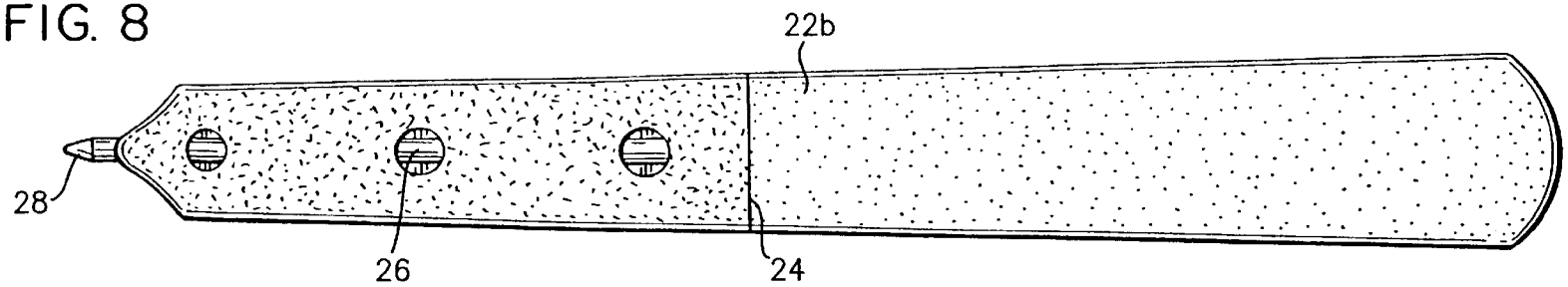
FIG. 8 is a top plan view in the opened, operative state.
Figure 9:
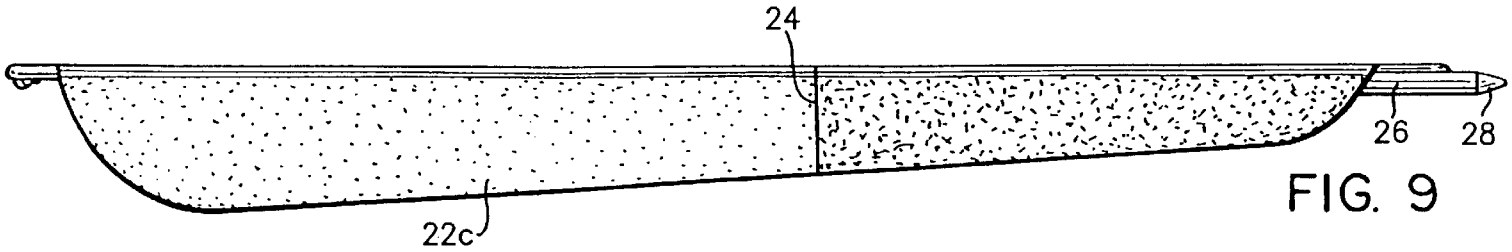
FIG. 9 is a front side view in the opened, operative state, the rear side view being a mirror image.
Figure 12:
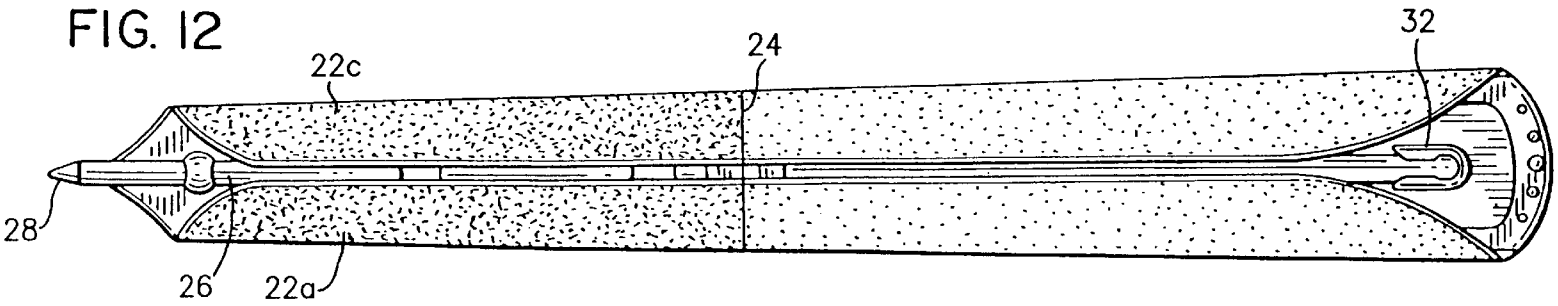
FIG. 12 is a bottom plan view in the opened state.

Referring to the drawings in detail, and initially to FIGS. 1–15, a flat folding writing instrument 10 according to one embodiment the present invention includes an elongated, generally planar support 12 which can be made from any suitable material, such as plastic, metal, for example, stainless steel, cardboard, paper, laminated paper, etc. In a preferred form, support 12 is made of polypropylene of a thickness which is less than the thickness of a conventional credit card. Support 12 can be die cut, injection molded, vacuum or thermoformed, machined, stamped or the like. Support 12 is shown having a generally rectangular shape, with a generally rounded top or front end 14 and a generally pointed or triangular bottom or rear end 16 which converges to an apex 18, although the present invention is not limited to this shape. The support 12 can have its outer surface textured, covered in leather or soft rubber, etc., for enhanced gripping and for improved aesthetics.

Support 12 includes two spaced apart fold lines or hinges 20*a* and 20*b* extending in a generally lengthwise direction of support 12, so as to divide support 12 into three lengthwise extending sections 22*a*, 22*b* and 22*c*. Fold lines 20*a* and 20*b* are preferably formed as living hinges, although other hinges, such as fabric hinges, mechanical hinges (with or without a hinge pin) or the like can be used, particularly when support 12 is made of metal or a material other than plastic. For example, self adhesive polyester films that would act as a hinge material, with die cut separate sections, can be used. In the case of paper or cardboard, score lines could be provided to form the living hinges. Each fold line 20*a* and 20*b* may alternatively be formed as a double or multiple fold line, that is, formed by two or more parallel, or broadly curved closely spaced apart fold lines, in order to make folding of planar support 12 into the final writing configuration easier.

In addition, a transverse fold line 24 is formed in planar support 12, slightly offset from a midpoint thereof. Transverse fold line 24 is used when the writing instrument is in its flat, storage position. More than one transverse fold line 24 can be provided.

A pen refill 26 is secured to the center section 22*b* to one side of transverse fold line 24 such that the ball point 28 of pen refill 26 is positioned at apex 18 and extends slightly below apex 18 for writing. Thus, the upper or rear end of pen refill 26 does not cross transverse fold line 24. By reference to pen refill 26, this is intended to cover conventional ball point pen refills, roller balls, felt tips or other pen-type refills, mechanical pencils, etc.

In order to secure pen refill 26 to center section 22*b*, any suitable means can be provided. For example, pen refill 26 can be secured to center section 22*b* by an adhesive or an adhesive film or by mechanical securing systems. Alternatively, as shown in FIGS. 13–16, a plurality of portions of center section 22*b* can be molded (for example, by using a mold with a "shut-off") so as to form securing arches 27, with pen refill 26 being pushed through openings defined by securing arches 27 and held therein by the pressure of the securing arches 27. Alternatively, as shown in FIG. 16, a raised section 27*a* can be provided in center section 22*b* with a lengthwise extending bore 27*b* therein for holding the pen refill 26.

In addition, to prevent accidental writing, that is, to provide a cover for the exposed ball point or other writing point 28, a ball point snap lock 32 is provided at center section 22*b* at the top end 14 of the writing instrument 10. When writing instrument 10 is in its folded, stored position, ball point 28 can be snap fitted into the resilient snap lock 32 and held therein in a protected state. This not only covers and prevents accidental writing of ball point 28, but also provides a pen-type lock to maintain the writing instrument in the closed, flat configuration of FIGS. 1–6.

The storage position (i.e., flat folded position) is shown in FIGS. 1–6, in which support 12 is folded along transverse fold line 24, and ball point 28 is snap fitted into snap lock 32. In this configuration, writing instrument 10 can approximately assume the size of a conventional credit card, business card or the like, and can be carried in a wallet, shirt pocket, etc.

Figure 13:
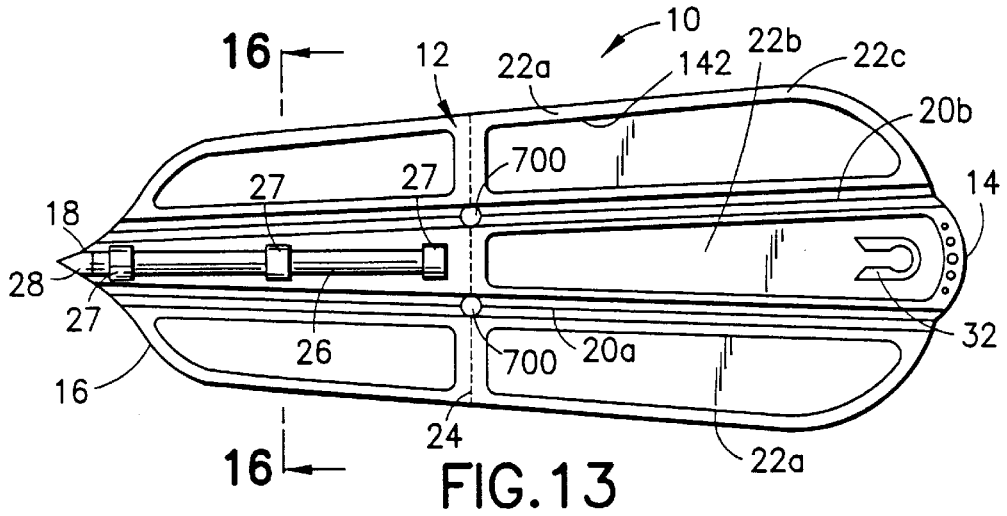
FIG. 13 is a top plan view of the writing instrument in its intermediate transition position.
Figure 14:
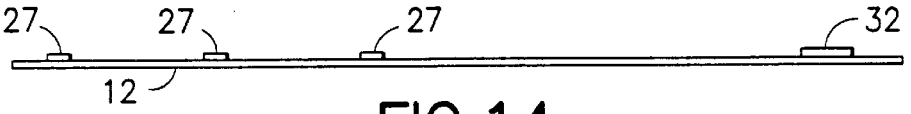
FIG. 14 is a side elevational view of the writing instrument of FIG. 13.
Figure 15:
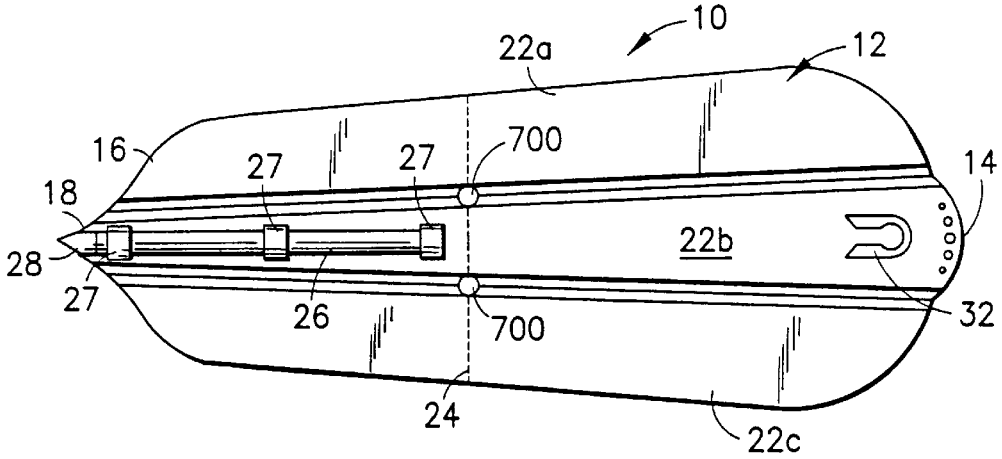
FIG. 15 is a bottom plan view of the writing instrument of FIG. 13.
Figure 16:
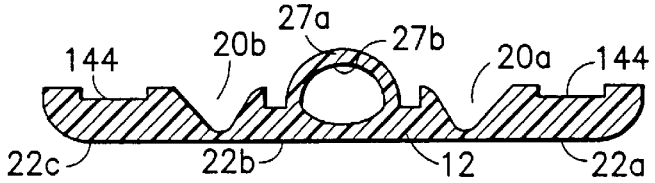
FIG. 16 is a cross-sectional view of the writing instrument of FIG. 13, taken along line 16—16 thereof.

When it is desired to use the writing instrument of the present invention, ball point 28 is first removed from resilient snap lock 32, and then support 12 is unfolded to an open planar configuration along transverse fold line 24, to the position as shown in FIGS. 13–15. Thereafter, planar support 12 is folded along lengthwise fold lines 20*a* and 20*b* until opposite lengthwise edges 12*a* and 12*b* are in contact, or at least, substantially in contact. As a result, writing instrument assumes a triangular cross-sectional configuration, as shown in FIGS. 7–12, and can be used for writing, as with a conventional pen. The free longitudinal edges can be secured to maintain the triangular shape shown in FIGS. 7–12 by various locking or securing devices described later herein.

Figure 15A:
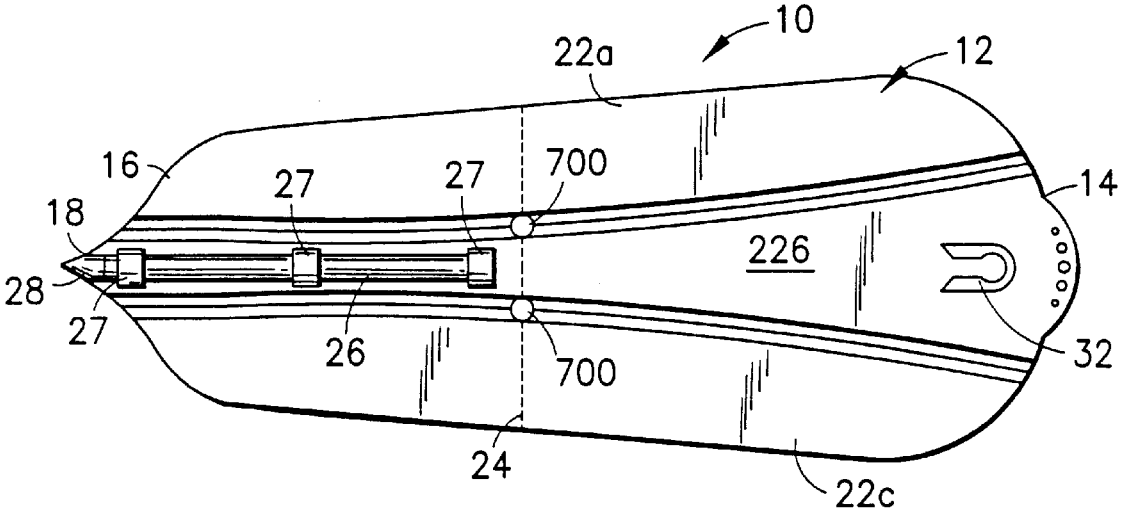
FIG. 15A shows a modified embodiment with curved fold lines.

It will be appreciated that many variations can be provided within the scope of the present invention. For example, more than two lengthwise fold lines can be provided, and the fold lines can be inwardly curved rather than straight (as shown in FIG. 15A). When the fold lines 20*a,* 20*b* are curved as in FIG. 15A, the writing instrument, in its unfolded operative condition, is slightly curved and the instrument more stably retains its operative state in a self-locking manner. Specifically, if three lengthwise fold lines are provided, the writing instrument will assume a generally square or rectangular cross-sectional configuration in operation. Alternatively, the formed cross-section can be circular, hexagonal, cross-shaped or the like. Also, more than two transverse fold lines can be provided in order to make a more compact writing instrument.

The openings 700 in each of FIGS. 2, 5, 6, 13, 15 15*a,* 24 and 26 are provided to facilitate folding of the writing instrument along the transverse hinge.

Figure 17:
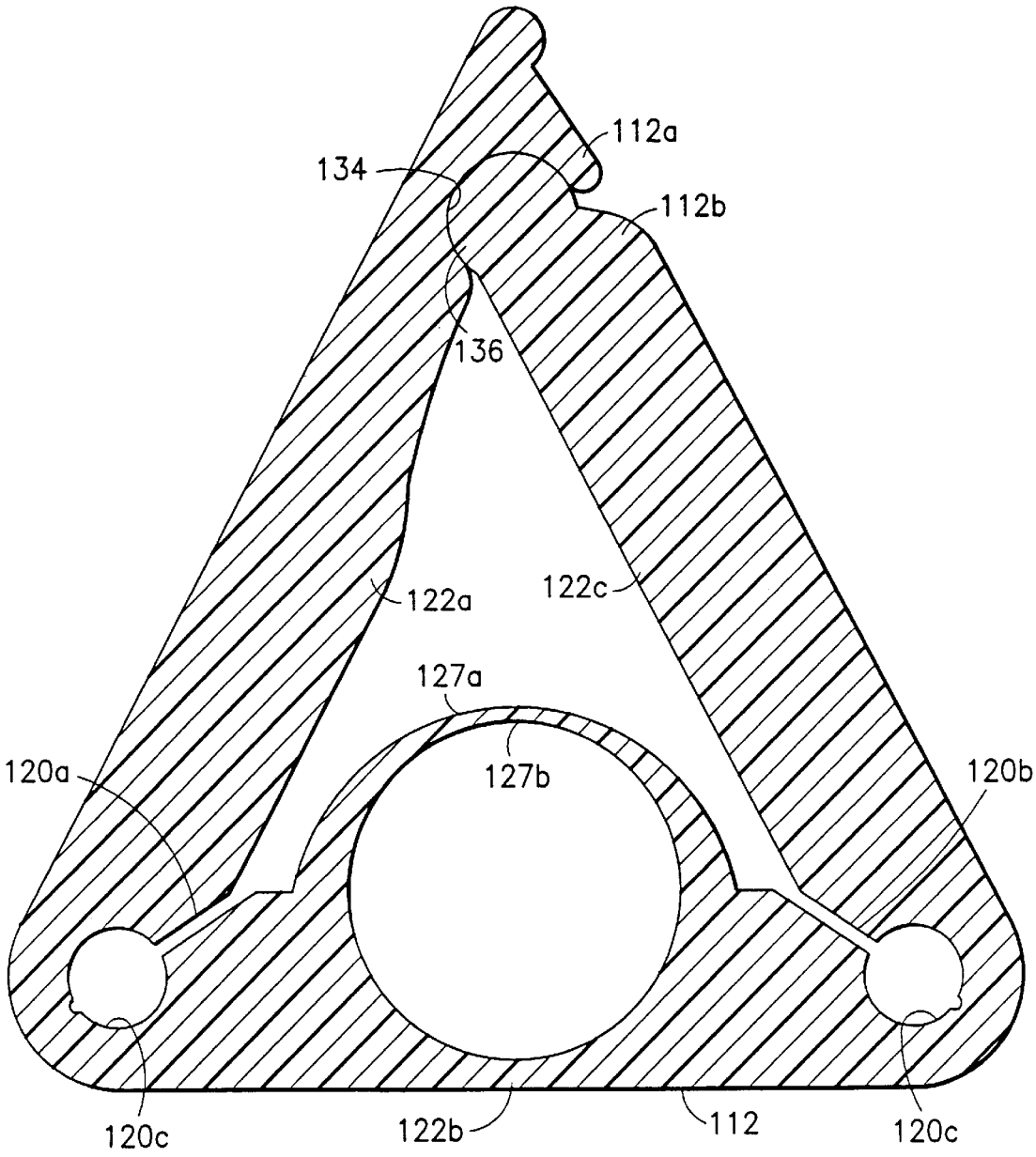
FIG. 17 is a cross-sectional view of a writing instrument according to another embodiment of the present invention.

Referring now to FIG. 17, a modified writing instrument 110 according to another embodiment of the present invention will now be described in which elements corresponding to those of writing instrument 10 are identified by the same reference numerals, augments by 100.

Specifically, in this embodiment of the invention shown in FIG. 17, an automatic or semi-automatic locking assembly is provided to lock writing instrument 110 in its operational or triangular configuration. As shown in FIG. 17, the bottom of each lengthwise fold line 120*a* and 120*b* is cut away (by molding) to form a cut-out 120*c* which may be circular (as shown) or any other shape. Portions 120*c* facilitate folding. Further, lengthwise extending section 122*a* of support 112 is formed with a groove 134 extending along the length direction, adjacent to its free lengthwise edge 112*a,* with groove 134 having a generally circular cross-sectional configuration. Lengthwise edge 112*b* at the opposite side of support 112 is formed with an elongated edge lock 136 extending along the length direction, with edge lock 136 having a generally circular cross-sectional configuration of a diameter such that it can snap into groove 134 to detachably secure edges 112*a* and 112*b* together. Groove 134 may have its generally circular portion extending more than 180° of a circle to provide for a snap type fit of edge lock 136 therein due to the resiliency of the plastic material.

In the embodiment of FIG. 17, center section 122*b* is formed with a raised lengthwise extending portion 127*a* (or a plurality of separated portions 127*a* similar to raised portions 27 of FIGS. 13–15) having a lengthwise bore 127*b* therein for holding the pen refill.

Alternatively, other locking arrangements can be used. For example, the invention can use "VELCRO" tabs, snaps, tabs, magnets, a molded over center retainer clip, incremental click stops (see FIG. 21), etc.

Figure 21:
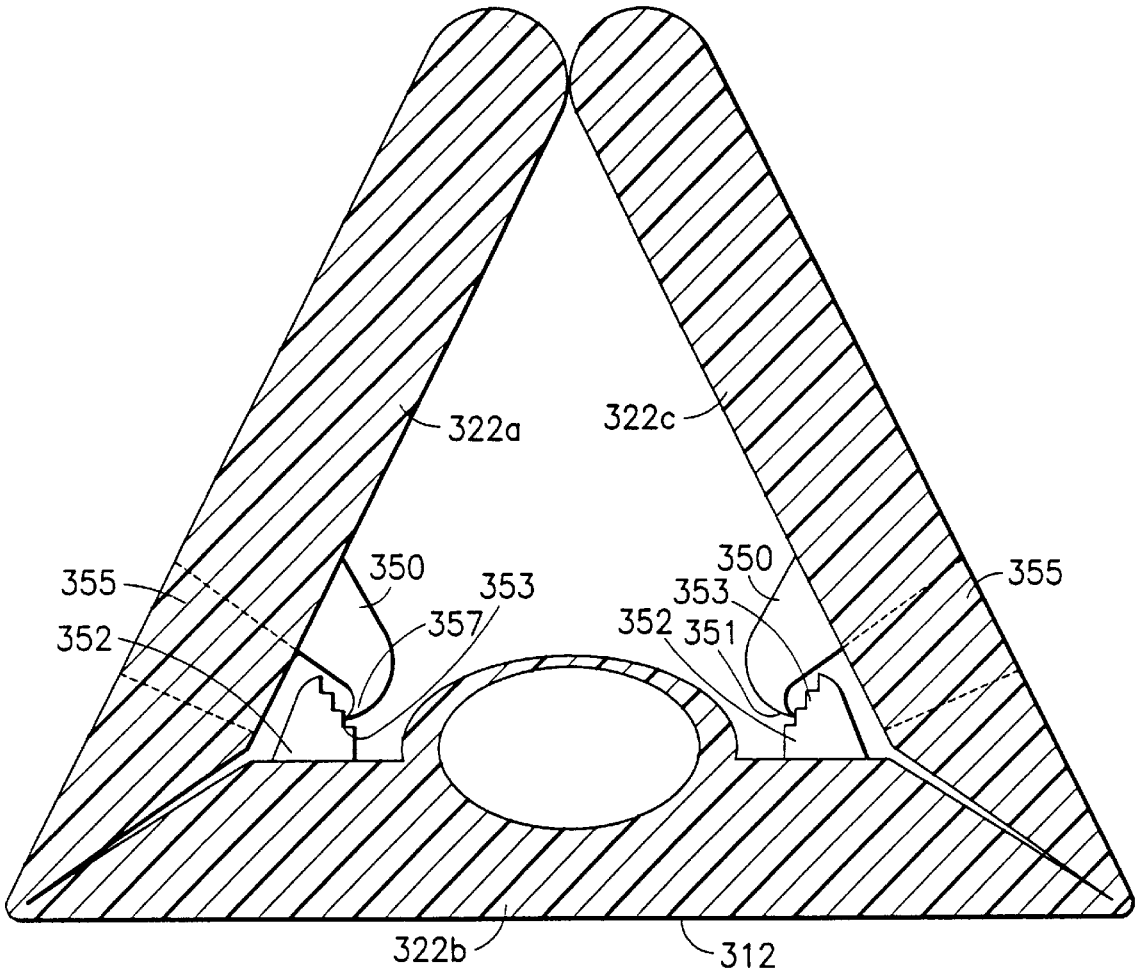
FIG. 21 is a cross-sectional view showing another locking arrangement of the present invention.

FIG. 21 shows a cross-sectional view similar to that of FIG. 17, except illustrating a different locking arrangement. In FIG. 21, the lengthwise extending sections 322*a,* 322*c* each have a projecting member 350 extending therefrom, as shown in FIG. 21. A single lengthwise extending member 350 can be provided on each of members 322*a* and 322*c,* or separate units can be provided separated along the length of members 322*a* and 322*c.* Separate spaced apart members 350 are preferred. The resilient plastic members 350 are, as in the other embodiments, formed by molding. The members 350 have pointed edges 351 which engage step-like or ratchet-like portions 353 of projecting members 352. In use, the portions 322*a* and 322*c* are folded to the position shown in FIG. 21, and the pointed members 351 engage the ratchet-like edges 353 of members 352, as shown in FIG. 21. Due to the inherent resiliency of the materials from which the device is molded, audible "clicks" are heard by the user as the pointed portions 351 engage steps of surface 353.

The inwardly projecting pointed members 351 are formed by using lock-outs during molding, resulting in openings 355 being formed in portions 322*a,* 322*c* at the positions where the members 350 are molded.

Figure 22:
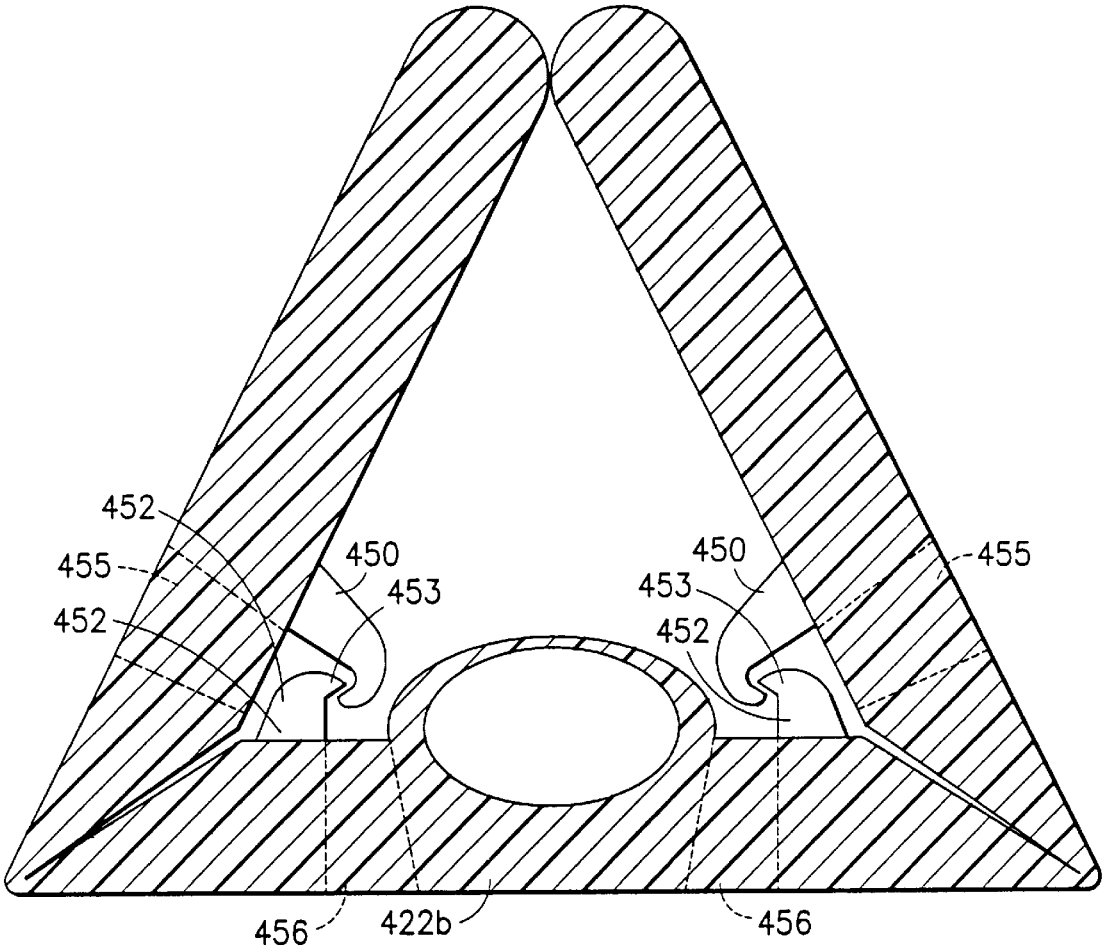
FIG. 22 is a modified embodiment of the arrangement of FIG. 21.

FIG. 22 shows an embodiment similar to that of FIG. 21. The projecting members 450 are similar to members 350 of FIG. 21 and engage projecting members 452. Projecting members 452 have generally pointed ends 453 which engage pointed ends of members 450. Members 452 are preferably molded by using lock-outs, resulting in openings 456 being formed in the portion 422*b*. Preferably, the members 450, 452 are provided spaced along the length of the writing instrument. As in the embodiment of FIG. 21, when the instrument is assembled for use to the triangular shape as shown, the snap locks engage and maintain the instrument in its writing condition.

Figure 23:
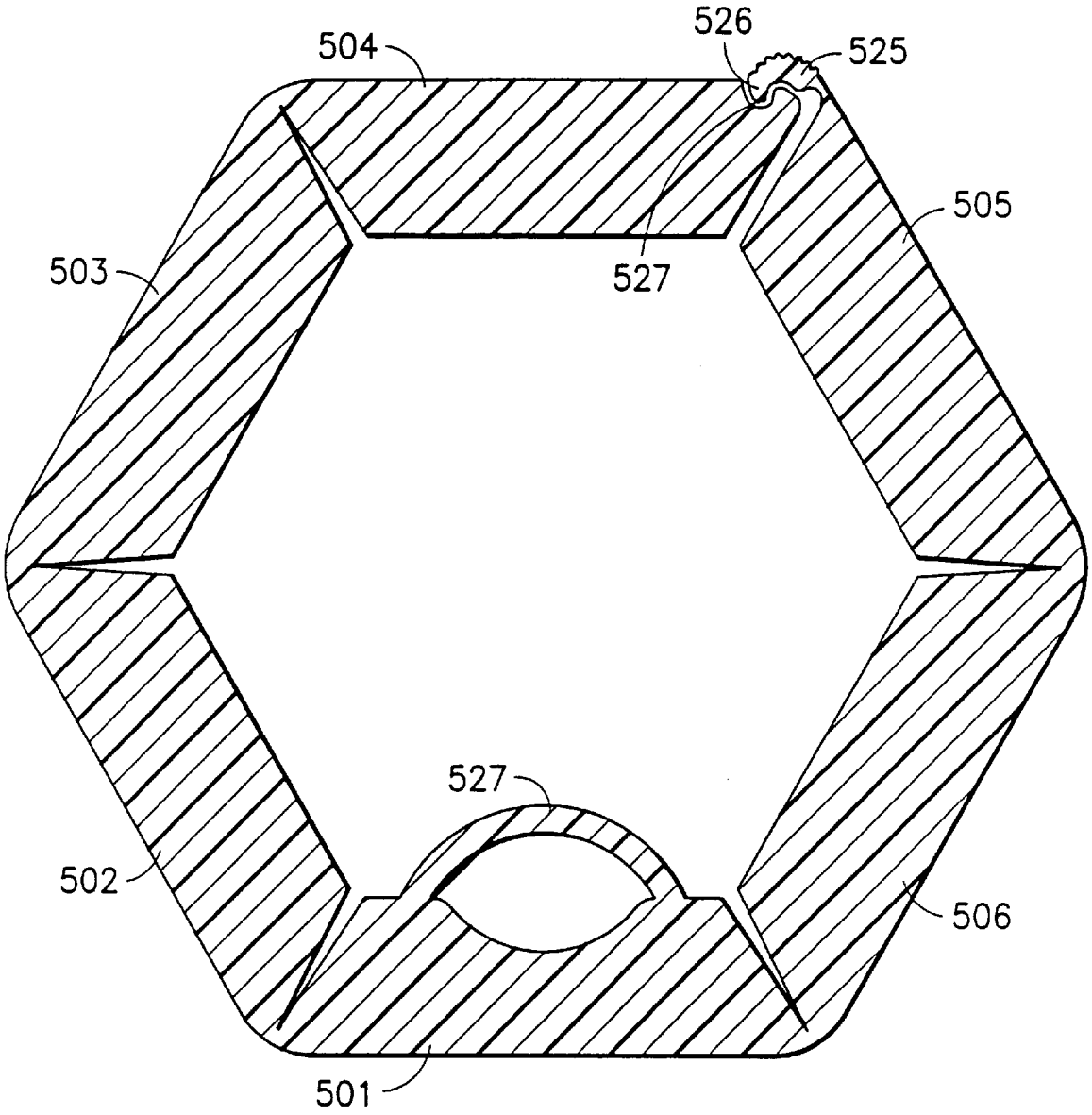
FIG. 23 is a modified embodiment showing a hexagonal writing instrument in its operative state.

FIG. 23 shows a hexagonal arrangement wherein the support member comprises six hingedly connected sections 501–506 which open to a flat condition and have a transverse fold line, such as fold line 24 shown in FIG. 13. The hinge portions between the sections 501–506 are the same as hinge portions for fold lines 20*a,* 20*b* of the first embodiment. As shown in FIG. 23, a pen or writing refill (not shown) is retained relative to section 501 by means of molded portions 527, similar to portions 27 of FIGS. 1–15.

The arrangement of FIG. 23 includes a locking member 525 which is integrally molded with section 505 and which projects from section 505. The locking member 525 has a locking tip 526 which engages into a groove 527 in section 504 which, when the writing instrument is in its operative condition, is adjacent section 505 so as to lock the writing instrument into its operative hexagonal state shown in FIG. 24.

Figure 24:
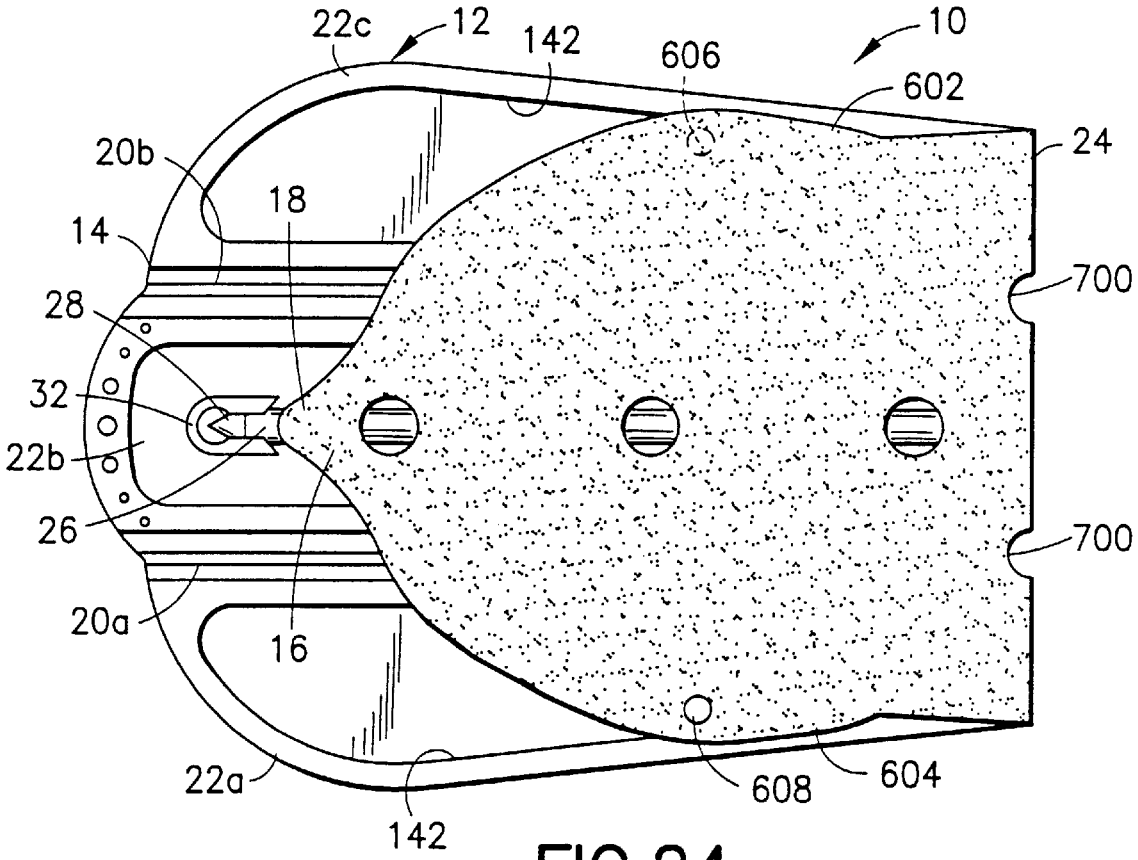
FIG. 24 shows a further modified embodiment with a preferred snap lock for retaining the writing instrument in its open, operative position.

FIG. 24 shows a modified embodiment of FIGS. 1 and 2, wherein the snap-type locking members for maintaining the writing instrument in a triangular operative position are provided in outwardly extending portions 602, 604. More specifically, in outwardly bulging portion 602, a projection 606 is provided which projects downwardly into the paper in FIG. 24, and a corresponding opening 608 is provided in outwardly bulging section 604. The projection 606 is adapted to snappingly fit or frictionally engage into the opening 608 when the writing instrument is assembled to its operative condition.

Figure 25:
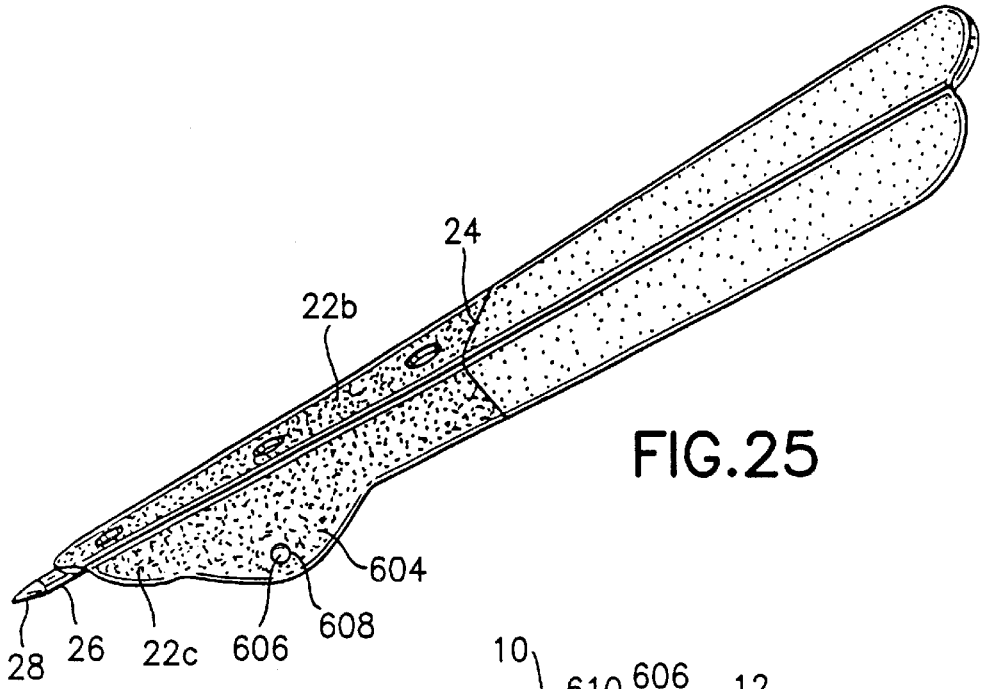
FIG. 25 is a perspective view of the embodiment of FIG. 24, showing the snap-lock arrangement in operation.

FIG. 25 shows the embodiment of FIG. 24 in its operative condition. The projection 606 projects through the opening 608, as shown in FIG. 25, to lock the writing instrument into its operative condition as shown in FIG. 25. The outwardly bulging section 604 is exaggerated in FIG. 25 for ease of illustration.

Figure 26:
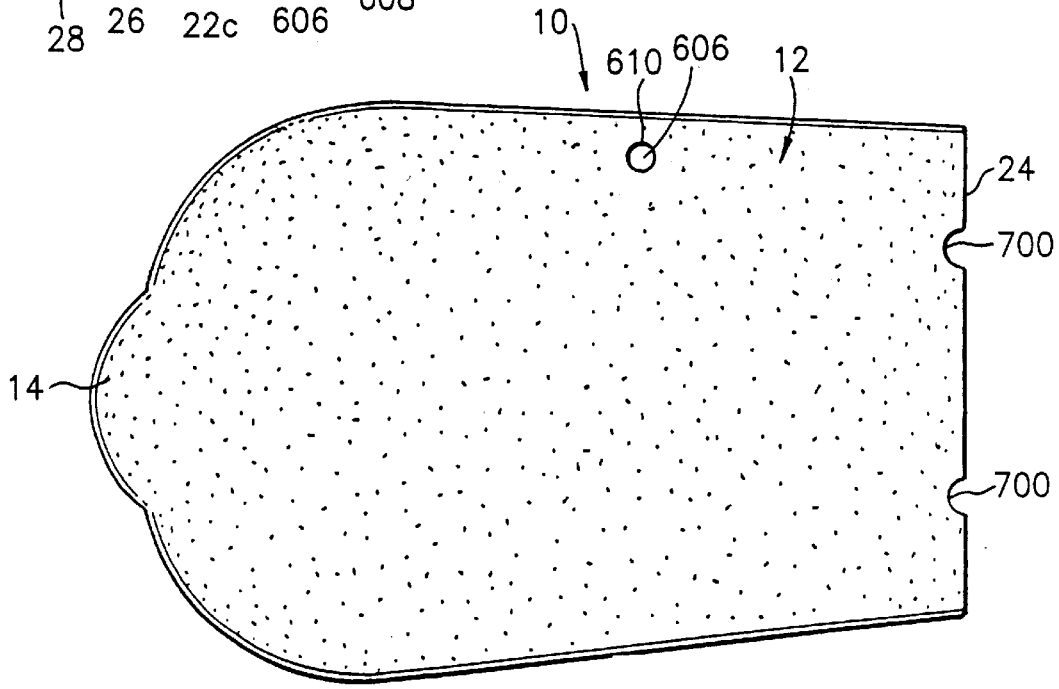
FIG. 26 is a rear view of the folded flat embodiment of FIG. 24, showing retention of the projection 606 in an opening of the rear portion of the writing instrument in the flat folded state.
Figure 27:
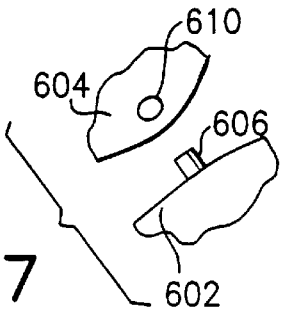
FIG. 27 is a fragmentary view showing the locking structure.

FIG. 26 shows the rear view of the modified embodiment of FIG. 24, with an additional opening 610 provided in the bottom portion thereof. In the folded state, the opening 610 receives the projection 606 therein, so as to further enhance locking of the instrument in its folded condition, and to provide a receptacle for retention of the projection 606 so that the downwardly directed projection 606 does not provide an objectionable bulge in the writing instrument when it is in its folded flat condition.

It will be appreciated that various modifications can be made to the invention within the scope of the claims.

Figure 18:
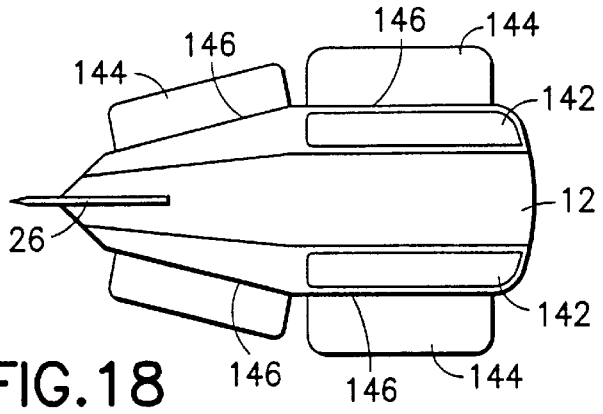
FIG. 18 is a top plan view of a writing instrument according to another embodiment of the present invention.

For example, as shown in FIGS. 1, 2, 13 and 15, compartments or depressions 142 can be formed in sections 22*a* and 22*c.* Alternatively, as shown in FIG. 18, flaps 144 can be formed at lengthwise edges 12*a* and 12*b* by living hinges 146, in order to cover the compartments 142. Compartments 142 can be formed by recesses in support 12 or by any other suitable means, and can be used for carrying miscellaneous items, such as flattened silicon ear putty for sound suppression, scrap paper, acupuncture press tacks, bandages, etc. For example, compartments 142 can accept snap in items, such as Fresnel lenses to be used for magnification.

As another modification, if the writing instrument is formed in the shape of a credit card, a pocket can be provided on the rear side thereof for holding a business card or the like.

Figure 19:
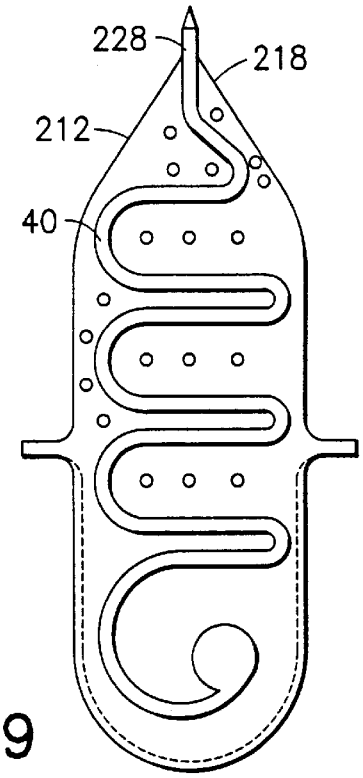
FIG. 19 is a top plan view of a writing instrument according to another embodiment of the present invention.
Figure 20:
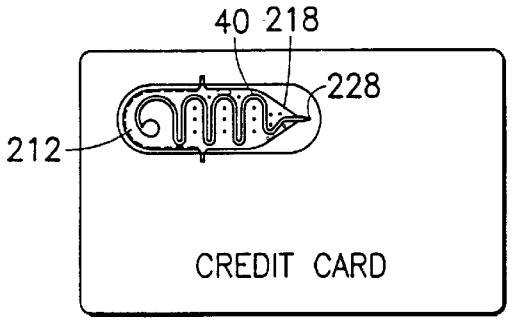
FIG. 20 is a view showing the embodiment of FIG. 19 mounted in a credit card-type device.

As shown in FIG. 19, a generally flat support 12 can be bonded into a pressure tight unit made up of two or three (or more) layers of metal or plastic to provide an intestine like or meandering cavity 40 for holding pressurized ink, which is connected with a ball point 228 at apex 218. The unit of FIG. 19 can be made small and can be fit into a slot of the credit card size member, as shown in FIG. 20.

Having described specific preferred embodiments of the invention with reference to the accompanying drawings, it will be appreciated that the present invention is not limited to those precise embodiments, and that various changes and modifications can be effected therein by one of ordinary skill in the art within the scope and spirit of the claims.

What is claimed is:

1. A flat folding writing instrument comprising:

a generally planar elongated support, said support including:

a lengthwise direction, at least two spaced apart hinges extending in a generally lengthwise direction of said support, so as to divide said support into at least three lengthwise extending sections, and two opposite lengthwise edges and a bottom edge;

a writing member secured to one of said sections and having a writing end thereof extending below said bottom edge;

wherein said support is foldable along said hinges such that when said support is folded, said two opposite lengthwise edges are adjacent to each other so that said writing instrument can be used for writing.

2. A flat folding writing instrument according to claim 1, wherein said support includes a further hinge extending in a generally widthwise direction thereof so as to divide said support into two widthwise extending sections, and said writing member is secured to only one of said widthwise extending sections.

3. A flat folding writing instrument according to claim 2, wherein said writing member is a pen refill.

4. A flat folding writing instrument according to claim 3, further including a pen cover secured to the other widthwise extending section for engaging an end of said pen refill when said support is folded along said further hinge.

5. A flat folding writing instrument according to claim 1, wherein said writing member is a pen refill.

6. A flat folding writing instrument according to claim 5, wherein said pen refill has an elongated hollow portion which is partially flattened to have a generally oval cross-sectional shape.

7. A flat folding writing instrument according to claim 1, further including securing members on said support for securing said writing member to said support.

8. A flat folding writing instrument according to claim 7, wherein said securing members include securing arches on said support.

9. A flat folding writing instrument according to claim 1, wherein each said hinge is a living hinge.

10. A flat folding writing instrument according to claim 1, further including at least one compartment or receptacle in at least one of said lengthwise extending sections.

11. A flat folding writing instrument according to claim 10, further including a flap associated with each compartment, each said flap being hingedly secured to said support for openably covering a respective compartment.

12. A flat folding writing instrument comprising:

a generally planar elongated support, said support including:

a lengthwise direction, at least two spaced apart hinges extending in a generally lengthwise direction of said support, so as to divide said support into at least three lengthwise extending sections, and two opposite lengthwise edges and a bottom edge;

a writing member secured to one of said sections and having a writing point thereof extending below said bottom edge;

a locking assembly for securing said two edges together when said support is folded along said hinges; and wherein said support is foldable along said hinges such that when said support is folded, said two opposite lengthwise edges are adjacent to each other and are locked in position relative to each other by said locking assembly, so that said writing instrument can be used for writing.

13. A flat folding writing instrument according to claim 12, wherein said support includes a further hinge extending in a generally widthwise direction thereof so as to divide said support into two widthwise extending sections, and said writing member is secured to only one of said widthwise extending sections.

14. A flat folding writing instrument according to claim 13, further including a cover secured to the other widthwise extending section for engaging a writing end of said writing member when said support is folded along said further hinge.

15. A flat folding writing instrument according to claim 12, further including securing members on said support for securing said writing member to said planar support.

16. A flat folding writing instrument according to claim 15, wherein said securing members include securing arches on said support.

17. A flat folding writing instrument according to claim 12, wherein each said hinge is a living hinge.

18. A flat folding writing instrument according to claim 12, further including at least one compartment or receptacle in at least one of said lengthwise extending sections.

19. A flat folding writing instrument according to claim 18, further including a flap associated with each compartment, each said flap being hingedly secured to said support for openably covering a respective compartment.

20. A flat folding writing instrument according to claim 12, wherein said locking assembly includes a projection on a free edge portion of one of said lengthwise extending sections, and an opening in a free edge portion of another of said lengthwise extending sections, said projection being lockingly engageable in said opening to lock said writing instrument in a writing position.

* * * * *